US010565953B2

(12) United States Patent
Kim et al.

(10) Patent No.: US 10,565,953 B2
(45) Date of Patent: Feb. 18, 2020

(54) DISPLAY DEVICE CAPABLE OF CHANGING FRAME FREQUENCY AND DRIVING METHOD THEREOF

(71) Applicant: Samsung Display Co., Ltd., Yongin-Si, Gyeonggi-Do (KR)

(72) Inventors: Jung-taek Kim, Seoul (KR); Sangwoo Choi, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 241 days.

(21) Appl. No.: 15/796,133

(22) Filed: Oct. 27, 2017

(65) Prior Publication Data

US 2018/0122327 A1 May 3, 2018

(30) Foreign Application Priority Data

Oct. 31, 2016 (KR) ..... 10-2016-0143492

(51) Int. Cl.
*G09G 3/36* (2006.01)

(52) U.S. Cl.
CPC ..... *G09G 3/3696* (2013.01); *G09G 3/3674* (2013.01); *G09G 3/3685* (2013.01); *G09G 2310/0289* (2013.01); *G09G 2310/08* (2013.01); *G09G 2320/0252* (2013.01); *G09G 2330/02* (2013.01)

(58) Field of Classification Search
CPC .. G09G 3/3696; G09G 3/3674; G09G 3/3685; G09G 3/3688; G09G 2310/0289; G09G 2310/08; G09G 2320/0252; G09G 2330/02
See application file for complete search history.

(56) References Cited

U.S. PATENT DOCUMENTS

2012/0105425 A1* 5/2012 Sasanuma ..... G09G 3/3655 345/212
2013/0002641 A1* 1/2013 Kim ..... G09G 3/3685 345/212
2015/0009241 A1* 1/2015 Kim ..... G09G 3/3648 345/690
2015/0145758 A1* 5/2015 Lee ..... G09G 3/3648 345/87

(Continued)

FOREIGN PATENT DOCUMENTS

KR 1020090105486 A 10/2009
KR 1020150081848 A 7/2015

*Primary Examiner* — Tom V Sheng
(74) *Attorney, Agent, or Firm* — Cantor Colburn LLP

(57) ABSTRACT

A display device includes a display panel including a gate driving circuit which drives gate lines, a data driving circuit which drives data lines based on an image data signal and a driving reference voltage, and a driving controller which controls the gate driving circuit in response to an image signal and a control signal and provides the image data signal and the driving reference voltage to the data driving circuit. The driving controller generates a data enable signal having a display section and a blank section in one frame based on the control signal, and when a difference between a time length of the blank section of a current frame and a time length of the blank section of a previous frame is greater than a reference value, changes the driving reference voltage to a voltage level corresponding to a current frame frequency.

19 Claims, 13 Drawing Sheets

(56) References Cited

U.S. PATENT DOCUMENTS

| | | | | |
|---|---|---|---|---|
| 2015/0194118 | A1* | 7/2015 | Lee | G09G 3/3688 345/99 |
| 2017/0124985 | A1* | 5/2017 | Kim | G09G 3/34 |
| 2017/0206850 | A1* | 7/2017 | Kim | G09G 3/3696 |
| 2018/0090084 | A1* | 3/2018 | Zheng | G09G 3/3611 |
| 2018/0103231 | A1* | 4/2018 | Ahn | G09G 5/005 |

* cited by examiner

DISPLAY DEVICE CAPABLE OF CHANGING FRAME FREQUENCY AND DRIVING METHOD THEREOF

This application claims priority to Korean Patent Application No. 10-2016-0143492, filed on Oct. 31, 2016, and all the benefits accruing therefrom under 35 U.S.C. § 119, the content of which in its entirety is herein incorporated by reference.

BACKGROUND

1. Field

Exemplary embodiments of the invention relate to a display device capable of changing a frame frequency and a driving method thereof.

2. Description of the Related Art

A display device generally includes a plurality of gate lines, a plurality of data lines, and a plurality of pixels connected to the plurality of gate lines and the plurality of data lines. The display device further includes a gate driving circuit for sequentially providing gate signals to the plurality of gate lines and a data driving circuit for outputting data signals to the plurality of data lines.

SUMMARY

High quality game images and virtual reality images require a considerable time to be rendered by a graphic processing processor. When a rendering time of an image signal of one frame is longer than the frame frequency of a display device, quality of an image displayed on the display device may be degraded.

Exemplary embodiments of the invention provide a display device for improving the quality of a display image.

Exemplary embodiments of the invention also provide a driving method of a display device for improving the quality of a display image.

An exemplary embodiment of the invention provides a display device including a display panel including a plurality of pixels that are respectively connected to a plurality of gate lines and a plurality of data lines, a gate driving circuit which drives the plurality of gate lines, a data driving circuit which drives the plurality of data lines based on an image data signal and a driving reference voltage, and a driving controller which controls the gate driving circuit in response to an image signal and a control signal received from an outside and provides the image data signal and the driving reference voltage to the data driving circuit, where the driving controller generates a data enable signal having a display section and a blank section in one frame based on the control signal, and when a difference between a time length of the blank section of a current frame and a time length of the blank section of a previous frame is greater than a reference value, changes the driving reference voltage provided to the data driving circuit to a voltage level corresponding to a current frame frequency.

In an exemplary embodiment, the driving reference voltage may have a voltage level corresponding to a white gamma signal.

In an exemplary embodiment, when the difference between the time length of the blank section of the current frame and the time length of the blank section of the previous frame is greater than the reference value and the time length of the blank section of the current frame is longer than the time length of the blank section of the previous frame, the driving controller may increase a voltage level of the driving reference voltage by a predetermined level.

In an exemplary embodiment, when the difference between the time length of the blank section of the current frame and the time length of the blank section of the previous frame is greater than the reference value and the time length of the blank section of the current frame is shorter than the time length of the blank section of the previous frame, the driving controller may decrease a voltage level of the driving reference voltage by a predetermined level.

In an exemplary embodiment, when the time length of the blank section of the current frame and the time length of the blank section of the previous frame are the same as each other during a predetermined frame, the driving controller may change the driving reference voltage to a voltage level corresponding to the current frame frequency.

In an exemplary embodiment, the driving controller may determine a frequency of the current frame according to the time length of the blank section of the current frame.

In an exemplary embodiment, the driving controller may include a controller which determines the frequency of the current frame based on the data enable signal and outputs a voltage control signal corresponding to the frequency of the current frame when a difference between a frequency of the previous frame and the frequency of the current frame frequency is greater than a reference value, and a voltage generator which generates the driving reference voltage in response to the voltage control signal.

In an exemplary embodiment, the controller may include a receiver which restores the data enable signal and a clock signal based on the control signal, and a control signal generator which determines a current frame blank time by counting the clock signal during the blank section of the data enable signal, and outputs the voltage control signal corresponding to the current frame blank time when a difference between the current frame blank time and a previous frame blank time is greater than the reference value.

In an exemplary embodiment, the control signal generator may include a frequency discriminator which counts the clock signal during the blank section of the data enable signal and output a current blank count signal, a frequency comparator which compares the current blank count signal and a previous blank count signal and outputs a voltage selection signal corresponding to the current blank count signal when a difference between the current blank count signal and the previous blank count signal is greater than the reference value, and a voltage controller which outputs the voltage control signal corresponding to the voltage selection signal.

In an exemplary embodiment, the control signal generator may further include a memory which stores the previous blank count signal.

In an exemplary embodiment, the frequency comparator may include a lookup table which stores a plurality of reference values respectively corresponding to a plurality of frequency sections, and may select a frequency section corresponding to the current blank count signal from the plurality of frequency sections and output the voltage selection signal corresponding to the current blank count signal when a difference between the current blank count signal and the previous blank count signal is greater than a reference value corresponding to the selected frequency section.

In an exemplary embodiment, the lookup table may include a first reference value corresponding to a first frequency section and a second reference value corresponding to a second frequency section, where the frequency comparator may output a first voltage selection signal corresponding to the blank count signal when a difference between the blank count signal and the previous blank count signal is greater than the first reference value when the current blank count signal corresponds to the first frequency section, and output a second voltage selection signal corresponding to the blank count signal when the difference between the blank count signal and the previous blank count signal is greater than the second reference value when the current blank count signal corresponds to the second frequency section, where a voltage level of the driving reference voltage corresponding to the first voltage selection signal may be higher than a voltage level of the driving reference voltage corresponding to the second voltage selection signal.

In an exemplary embodiment, the control signal generator may further include a counter which counts up when the current blank count signal is identical to the previous blank count signal and outputs a time count signal, where the frequency comparator may output the voltage selection signal corresponding to the current blank count signal when the time count signal corresponds to a predetermined time.

In an exemplary embodiment of the invention, a driving method of a display device includes generating a data enable signal having a display section and a blank section in one frame and a clock signal based on a received control signal, determining a current blank time by counting the clock signal during the blank section of the data enable signal, setting a driving reference voltage to a voltage level corresponding to the current frame blank time when a difference between the current frame blank time and a previous frame blank time is greater than a reference value, and providing the driving reference voltage to a data driving circuit.

In an exemplary embodiment, the driving reference voltage may have a voltage level corresponding to a white gamma signal.

In an exemplary embodiment, the setting the voltage level may include increasing a voltage level of the driving reference voltage by a predetermined level when the difference between the current frame blank time and the previous frame blank time is greater than the reference value and the current frame blank time is longer than the previous frame blank time.

In an exemplary embodiment, the setting the voltage level may include decreasing a voltage level of the driving reference voltage by a predetermined level when the difference between the current frame blank time and the previous frame blank time is greater than the reference value and the current frame blank time is shorter than the previous frame blank time.

In an exemplary embodiment, the setting the voltage level may include changing the driving reference voltage to a voltage level corresponding to the current frame blank time when the current frame blank time and the previous frame blank time are the same as each other during a predetermined frame.

In an exemplary embodiment, the setting of the voltage level may include changing the driving reference voltage to a voltage level corresponding to the current frame blank time when the current blank time is less than a first reference value and the difference between the current frame blank time and the previous frame blank time is greater than a first difference value, and changing the driving reference voltage to a voltage level corresponding to the current frame blank time when the current blank time is less than a second reference value and the difference between the current frame blank time and the previous frame blank time is greater than a second difference value, where the first reference value may be less than the second reference value.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION

Figure 1:
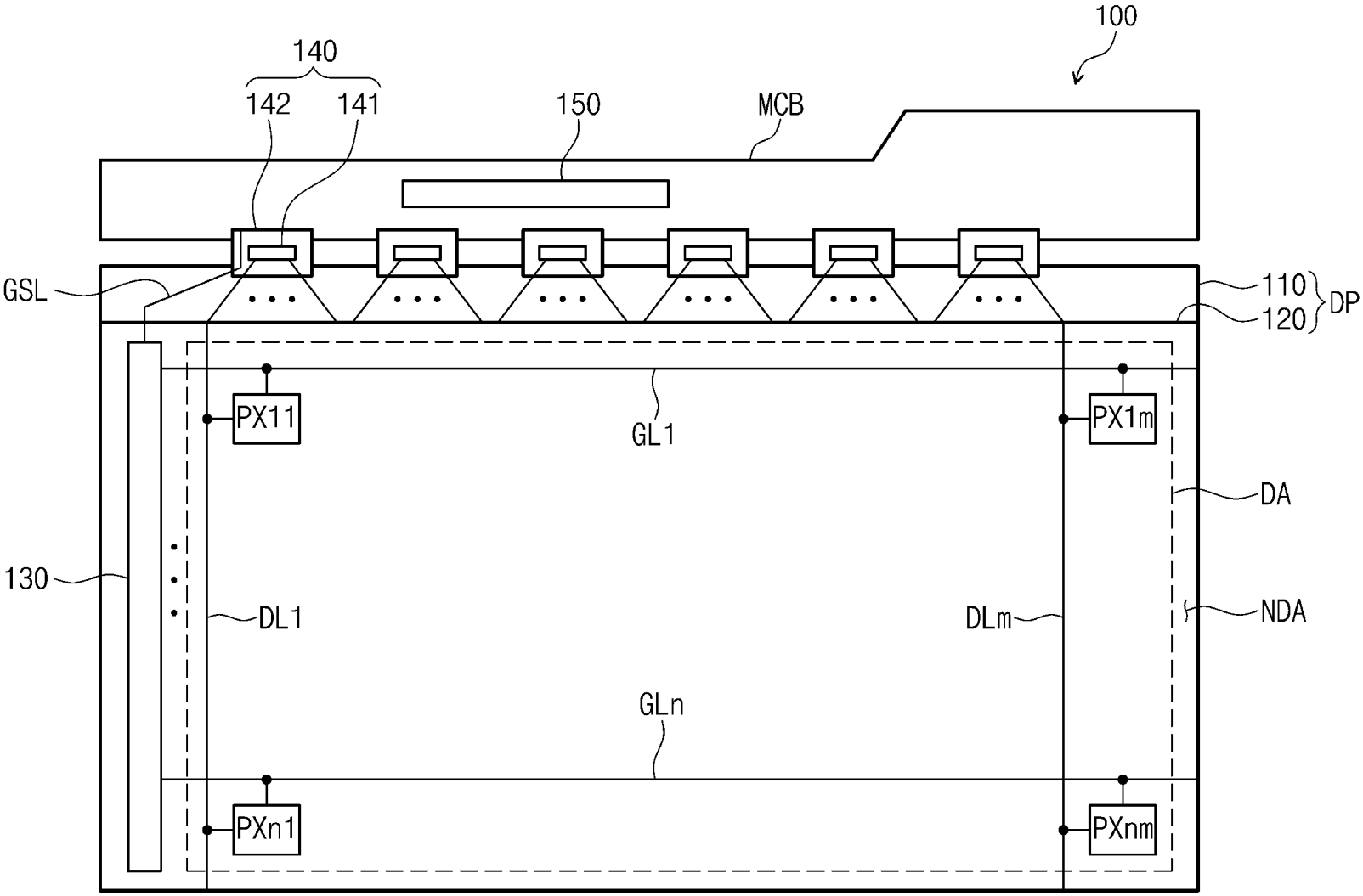
FIG. 1 is a plan view illustrating an exemplary embodiment of a display device according to the invention.

Hereinafter, exemplary embodiments of the invention are described in more detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
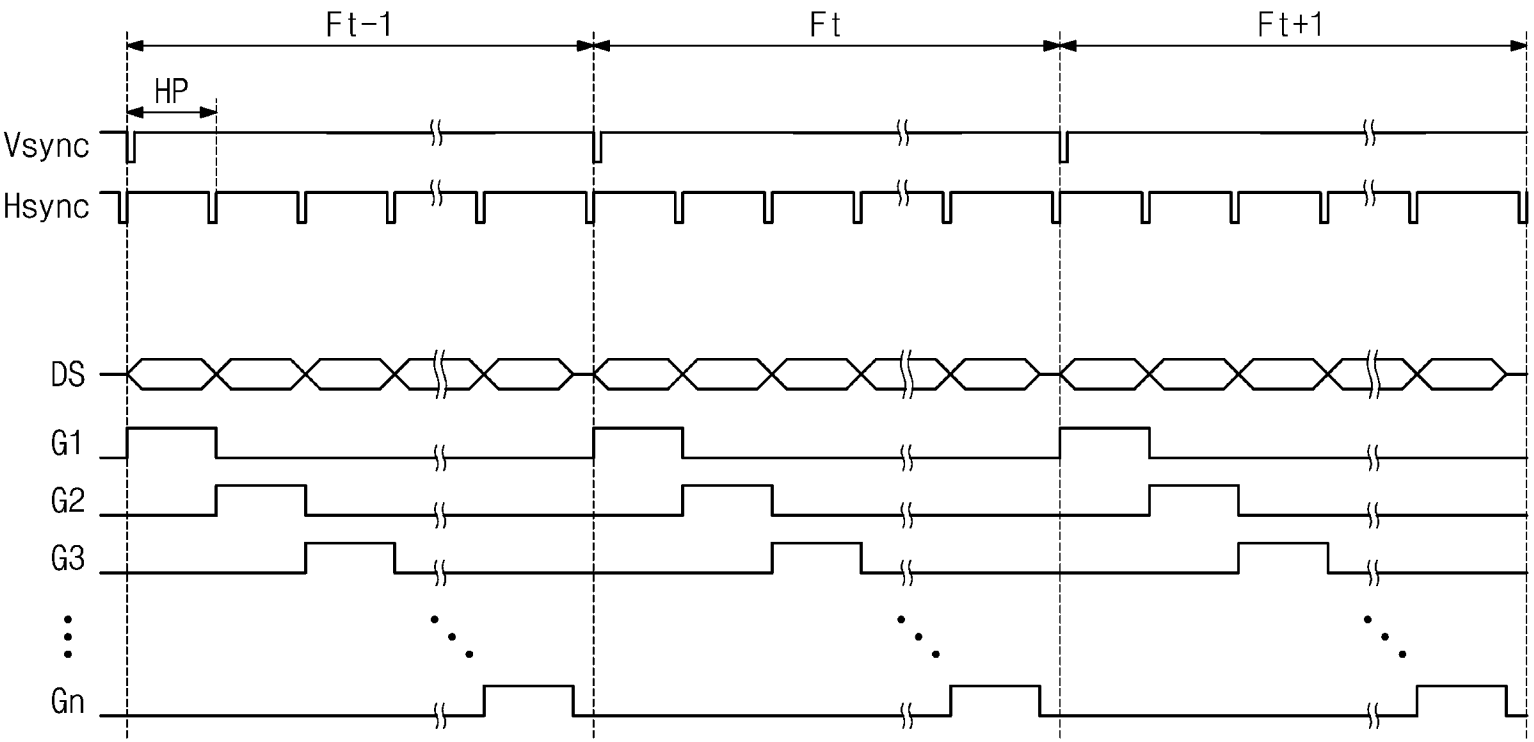
FIG. 2 is a timing diagram illustrating signals of an exemplary embodiment of a display device according to the invention.

FIG. 1 is a plan view of a display device according to an exemplary embodiment of the invention. FIG. 2 is a timing diagram illustrating signals of a display device according to an exemplary embodiment of the invention.

As shown in FIGS. 1 and 2, a display device 100 according to an exemplary embodiment of the invention includes a display panel DP, a gate driving circuit 130, a data driving circuit 140, and a driving controller 150.

The display panel DP is not particularly limited thereto, and for example, may include various display panels such as a liquid crystal display panel, an organic light emitting display panel, an electrophoretic display panel, and an electrowetting display panel. In the illustrated exemplary embodiment, the display panel DP is described as a liquid crystal display panel. The liquid crystal display device 100 including a liquid crystal display panel may further include a polarizer (not shown) and a backlight unit (not shown).

The display panel DP includes a first substrate 110, a second substrate 120 spaced apart from the first substrate 110, and a liquid crystal layer (not shown) disposed therebetween. On a plane, the display panel DP includes a display area DA where a plurality of pixels PX11 to PXnm and a non-display area NDA surrounding the display area DA.

The display panel DP includes a plurality of gate lines GL1 to GLn disposed on the first substrate 110 and a plurality of data lines DL1 to DLm intersecting the plurality of gate lines GL1 to GLn, where n and m are natural numbers greater than one. The plurality of gate lines GL1 to GLn is connected to the gate driving circuit 130. The plurality of data lines DL1 to DLm are connected to the data driving circuit 140. Only some of the plurality of gate lines GL1 to GLn and only some of the plurality of data lines DL1 to DLm are illustrated in FIG. 1.

Only some of the plurality of pixels PX11 to PXnm are illustrated in FIG. 1. The plurality of pixels PX11 to PXnm is respectively connected to corresponding gate lines among the plurality of gate lines GL1 to GLn and corresponding data lines among the plurality of data lines DL1 to DLm.

The plurality of pixels PX11 to PXnm may be divided into a plurality of groups according to a color displayed. The plurality of pixels PX11 to PXnm may display one of primary colors. The primary colors may include red, green, blue, and white. However, the exemplary embodiment of the invention is not limited thereto and thus the primary colors may further include various colors such as yellow, cyan, magenta, and so on.

The gate driving circuit 130 and the data driving circuit 140 receive a control signal from the driving controller 150. The driving controller 150 may be disposed (e.g., mounted) on a main circuit board MCB. The driving controller 150 receives image signals and control signals from an external graphic control unit (not shown). The control signals may include vertical sync signals Vsync that are signals for distinguishing frame sections Ft−1, Ft, and Ft+1, horizontal sync signals Hsync that are signals for distinguishing horizontal sections HP, that is, row distinction signals, and data enable signals (that are in high level only during a section where data is outputted to display a data incoming area), and clock signals.

The gate driving circuit 130 generates gate signals G1 to Gn on the basis of a control signal (hereinafter referred to as a gate control signal) received from the driving controller 150 through a signal line GSL and outputs the gate signals G1 to Gn to the plurality of gate lines GL1 to GLn, respectively, during the frame sections Ft−1, Ft, and Ft+1. The gate signals G1 to Gn may be sequentially outputted in correspondence to the horizontal sections HP. The gate driving circuit 130 and the pixels PX11 to PXnm may be formed simultaneously through a thin film process. In an exemplary embodiment, the gate driving circuit 130 may be disposed (e.g., mounted) mounted as an oxide semiconductor thin film transistor ("TFT") gate driver circuit ("OSG") in the non-display area NDA, for example.

FIG. 1 illustrates one gate driving circuit 130 connected to the left ends of the plurality of gate lines GL1 to GLn. According to an exemplary embodiment of the invention, the display device 100 may include two gate driving circuits. One of the two gate driving circuits may be connected to the left ends of the plurality of gate lines GL1 to GLn and the other one of the two gate driving circuits may be connected to the right ends of the plurality of gate lines GL1 to GLn. Additionally, one of the two gate driving circuits may be connected to odd gate lines and the other one of the two gate driving circuits may be connected to even gate lines.

The data driving circuit 140 generates grayscale voltages according to image data provided from the driving controller 150 on the basis of a control signal (hereinafter referred to as a data control signal) received from the driving controller 150. The data driving circuit 140 outputs the grayscale voltages as data voltages DS to the plurality of data lines DL1 to DLm.

The data voltages DS may include positive data voltages having a positive value with respect to a common voltage and/or negative data voltages having a negative value with respect to the common voltage. Some of data voltages applied to the data lines DL1 to DLm have a positive polarity and others of the data voltages have a negative polarity during each of the horizontal sections HP. The polarity of the data voltages DS may be inverted according to the frame sections Ft−1, Ft, and Ft+1 in order to prevent the deterioration of a liquid crystal. The data driving circuit 140 may generate data voltages inverted by each frame section unit in response to an invert signal.

The data driving circuit 140 may include a driving chip 141 and a flexible circuit board 142 on which the driving chip 141 is disposed (e.g., mounted). The flexible circuit board 142 connects the main circuit board MCB and the first substrate 110 electrically. The plurality of driving chips 141 provides data signals to corresponding data lines among the plurality of data lines DL1 to DLm.

FIG. 1 illustrates a tape carrier package ("TCP") type data driving circuit 140 exemplarily. According to another exemplary embodiment of the invention, the data driving circuit 140 may be disposed on the non-display area NDA of the first substrate 110 through a chip on glass ("COG") method, for example.

Figure 3:
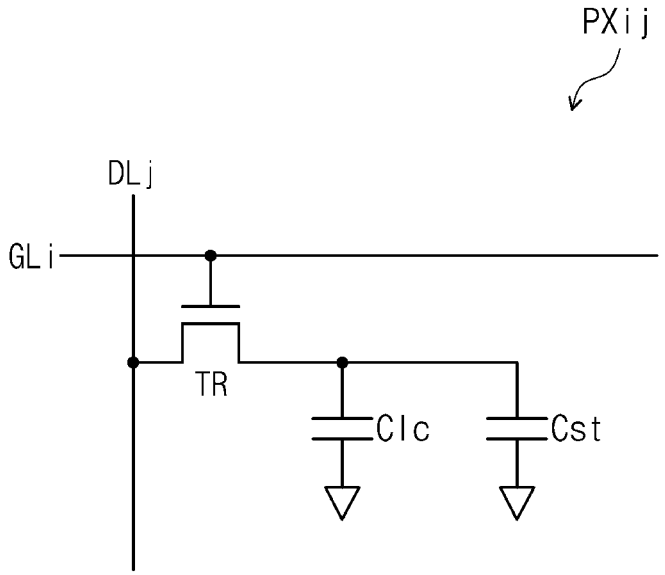
FIG. 3 is an equivalent circuit diagram of a pixel according to an exemplary embodiment of the invention.

FIG. 3 is an equivalent circuit diagram of a pixel according to an exemplary embodiment of the invention. Each of the plurality of pixels PX11 to PXnm shown in FIG. 1 may have an equivalent circuit shown in FIG. 3.

As shown in FIG. 3, the PXij includes a pixel TFT (hereinafter also referred to as a pixel transistor) TR, a liquid crystal capacitor Clc, and a storage capacitor Cst. Hereinafter, in the specification, a transistor refers to a TFT. According to another exemplary embodiment of the invention, the storage capacitor Cst may be omitted.

The pixel transistor TR is electrically connected to an ith gate line GLi and a jth data line DLj. The pixel transistor TR outputs a pixel voltage corresponding to a data signal received from the jth data line DLj in response to a gate signal received from the ith gate line GLi.

The liquid crystal capacitor Clc is charged with a pixel voltage outputted from the pixel transistor TR. An arrangement of liquid crystal directors included in a liquid crystal layer (not shown) is changed according to a charge amount charged in the liquid crystal capacitor CLC. The light incident to a liquid crystal layer may be transmitted or blocked according to an arrangement of liquid crystal directors.

The storage capacitor Cst is connected in parallel to the liquid crystal capacitor Clc. The storage capacitor Cst maintains an arrangement of liquid crystal directors during a predetermined section.

Figure 4:
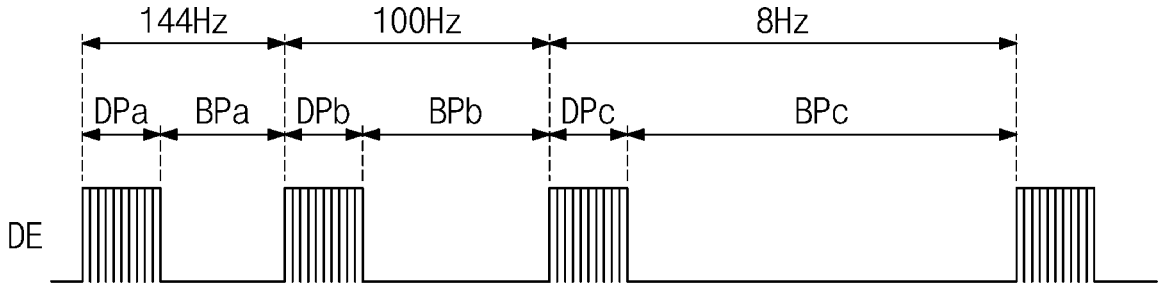
FIG. 4 is an exemplary diagram illustrating a blank section of a data enable signal according to a frame frequency.

FIG. 4 is an exemplary diagram illustrating a blank section of a data enable signal according to a frame frequency.

The frame sections Ft−1, Ft, and Ft+1 are identical to each other in the timing diagram shown in FIG. 2. That is, the frame frequency of the display device is constant. The driving controller 150 shown in FIG. 1 receives an image signal and a control signal from the outside. The image signal may be a signal rendered by a graphic processor (not shown). The blank section of the data enable signal DE included in the control signal may be changed in every frame according to the rendering time of the graphic processor.

As shown in FIG. 4, the data enable signal DE includes a display section DPx (x is a, b or c) and a blank section BPx in one frame. The time lengths of the display sections DPa, DPb and DPc of the data enable signal DE may be the same as one another in each frame but the time lengths of the blank sections BPa, BPb and BPc may be different from each other.

In an exemplary embodiment, when the rendering time of the graphics processor becomes long, the blank section of the data enable signal may be lengthened by the long rendering time, for example. As the blank section becomes longer, the frame frequency of the data enable signal DE may become lower.

When the blank section of the data enable signal DE becomes longer, that is, when the frame frequency becomes lower, the charges charged in the liquid crystal capacitor Clc and the storage capacitor Cst in the pixel PXij shown in FIG. 3 are decreased due to the leakage current. That is, as the blank section becomes longer, the luminance of the image displayed on the pixel PXij becomes lower. When the frame rate is changed for each frame, the time length of the blank section may be changed for each frame and this may cause a change in the reduction amount of luminance for each frame. As a result, a user recognizes flickers on the screen.

Figure 5A:
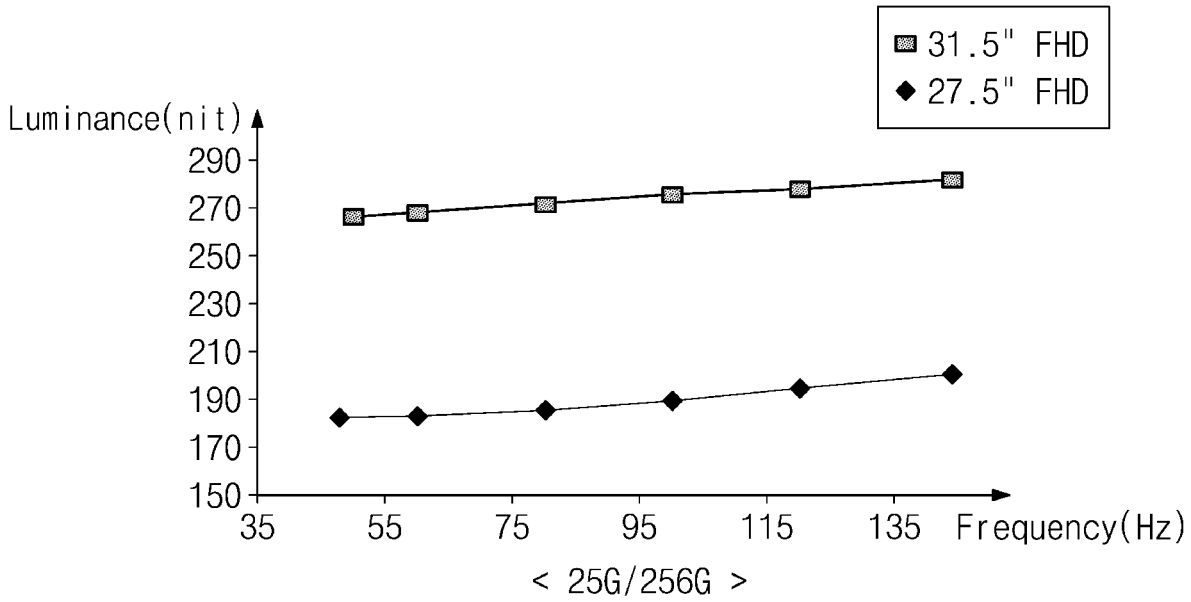
FIGS. 5A and 5B are views illustrating an exemplary change in luminance of an image according to a frame frequency.
Figure 5B:
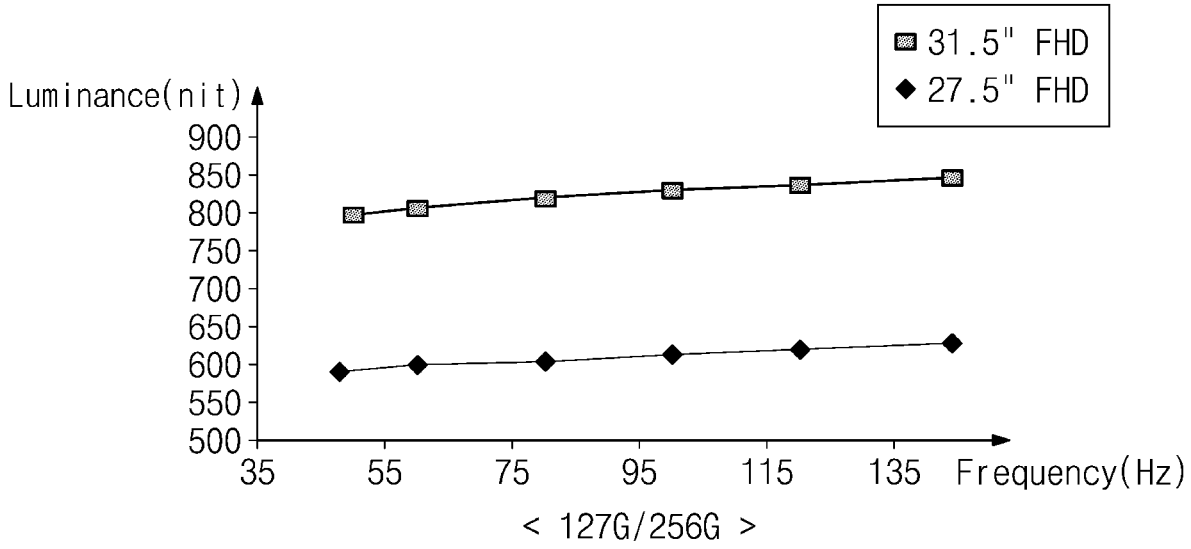

FIGS. 5A and 5B are views illustrating an exemplary change in luminance of an image according to a frame frequency.

Referring to FIG. 5A first, when an image corresponding to 25 grayscales (25G) is displayed on a display device capable of expressing 256 grayscales (256G), the luminance of the image is measured using a luminance meter. It may be seen that the luminance of both the 31.5-inch full high definition ("FHD") display and the 27.5-inch FHD display decreases as the frame frequency decreases while the same 25 grayscale image is displayed.

Referring to FIG. 5B, when an image corresponding to 127 grayscales (127G) is displayed on a display device capable of expressing 256 grayscales (256G), the luminance of the image is measured using a luminance meter. It may be seen that the luminance of both the 31.5-inch FHD display and the 27.5-inch FHD display decreases as the frame frequency decreases while the same 127 grayscale image is displayed.

Figure 6:
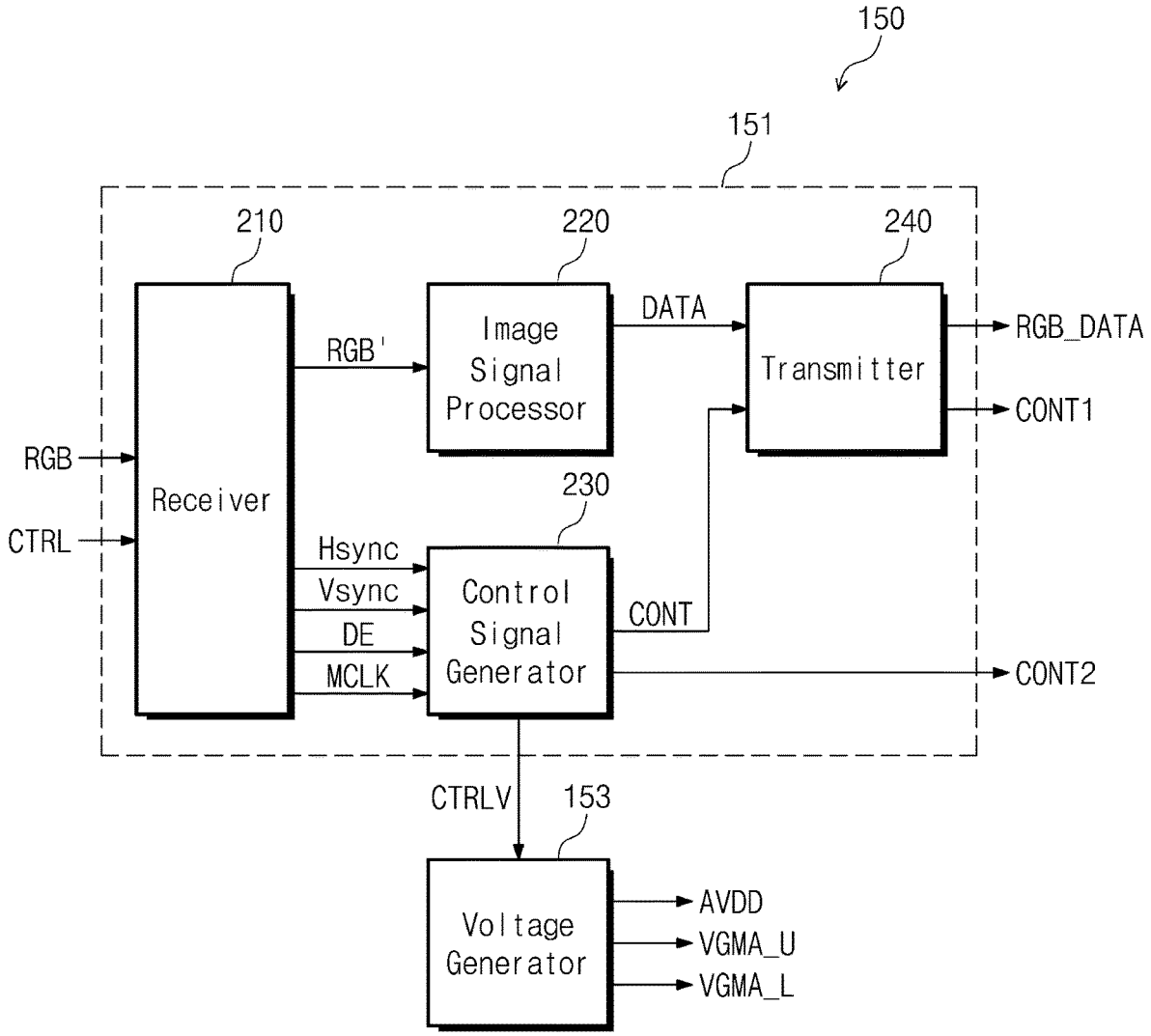
FIG. 6 is a block diagram illustrating an exemplary embodiment of a configuration of a driving controller according to the invention.

FIG. 6 is a block diagram illustrating a configuration of a driving controller according to an exemplary embodiment of the invention.

First, referring to FIG. 6, a driving controller 150 includes a controller 151 and a voltage generator 153. In response to the image signal RGB and the control signal CTRL received from the outside, the driving controller 150 outputs a first control signal CONT1 for controlling the data driving circuit 140 shown in FIG. 1 and an image data signal RGB_DATA, and outputs a second control signal CONT2 to be supplied to the gate driving circuit 130 (refer to FIG. 1). The first control signal CONT1 may include a clock signal CLK, a line latch signal LOAD, and a polarity inversion signal POL (refer to FIG. 7).

The driving controller 150 may restore the data enable signal DE having a display section and a blank section in one frame based on the control signal CTRL and may set the voltage level of a driving reference voltage supplied to the data driving circuit 140 shown in FIG. 1 according to the time length of the blank section. In an exemplary embodiment, the driving reference voltage may be a white gamma signal, for example. In the following description, it is described as one example that the driving controller 150 sets the voltage levels of the first gamma reference voltage VGMA_U and the second gamma reference voltage VGMA_L provided to the data driving circuit 140 depending on the time length of the blank section of the data enable signal DE.

The driving controller 150 includes a controller 151 and a voltage generator 153. The controller 151 includes a receiver 210, an image signal processor 220, a control signal generator 230, and a transmitter 240.

The receiver 210 restores the control signal CTRL to the data enable signal DE. The receiver 210 may further restore a horizontal synchronization signal Hsync, a vertical synchronization signal Vsync, and a main clock signal MCLK based on the control signal CTRL. In an exemplary embodiment, the image signal RGB and the control signal CTRL provided from the outside may be provided to the receiver 210 in a low voltage differential signaling ("LVDS") manner, for example.

The image signal processor 220 converts an image signal RGB' outputted from the receiver 210 into a data signal DATA. The image signal processor 220 may linearize the gamma characteristic of the image signal RGB' to be proportional to the luminance to output the data signal DATA.

The control signal generator 230 receives the horizontal synchronizing signal Hsync, the vertical synchronizing signal Vsync, the data enable signal DE, and the main clock signal MCLK from the receiver 210 and outputs a control signal CONT including the clock signal CLK, the line latch signal LOAD, and the polarity inversion signal POL and a second control signal CONT2 including a start signal and a clock pulse signal. The second control signal CONT2 is provided to the gate driving circuit 130 shown in FIG. 1.

The transmitter 240 outputs the data signal DATA as the image data signal RGB_DATA and outputs the clock signal CLK, the line latch signal LOAD, and the polarity inversion signal POL as the first control signal CONT1 output. The image data signal RGB_DATA and the first control signal CONT1 are provided to the data driving circuit 140 shown in FIG. 1. In an exemplary embodiment, the transmitter 240 may output the image data signal RGB_DATA and the first control signal CONT1 converted in a reduced signal differential signaling ("RSDS") manner, for example.

The control signal generator 230 provides the voltage control signal CTRLV to the voltage generator 153 based on the time length of the blank section of the data enable signal DE. In an exemplary embodiment, the control signal generator 230 and the voltage generator 153 may transmit and receive signals through an inter-integrated circuit ("I2C") interface, for example.

The voltage generator 153 receives the voltage control signal CTRLV from the controller 151 and generates the analog power supply voltage AVDD, the first gamma reference voltage VGMA_U, and the second gamma reference voltage VGMA_L.

Figure 7:
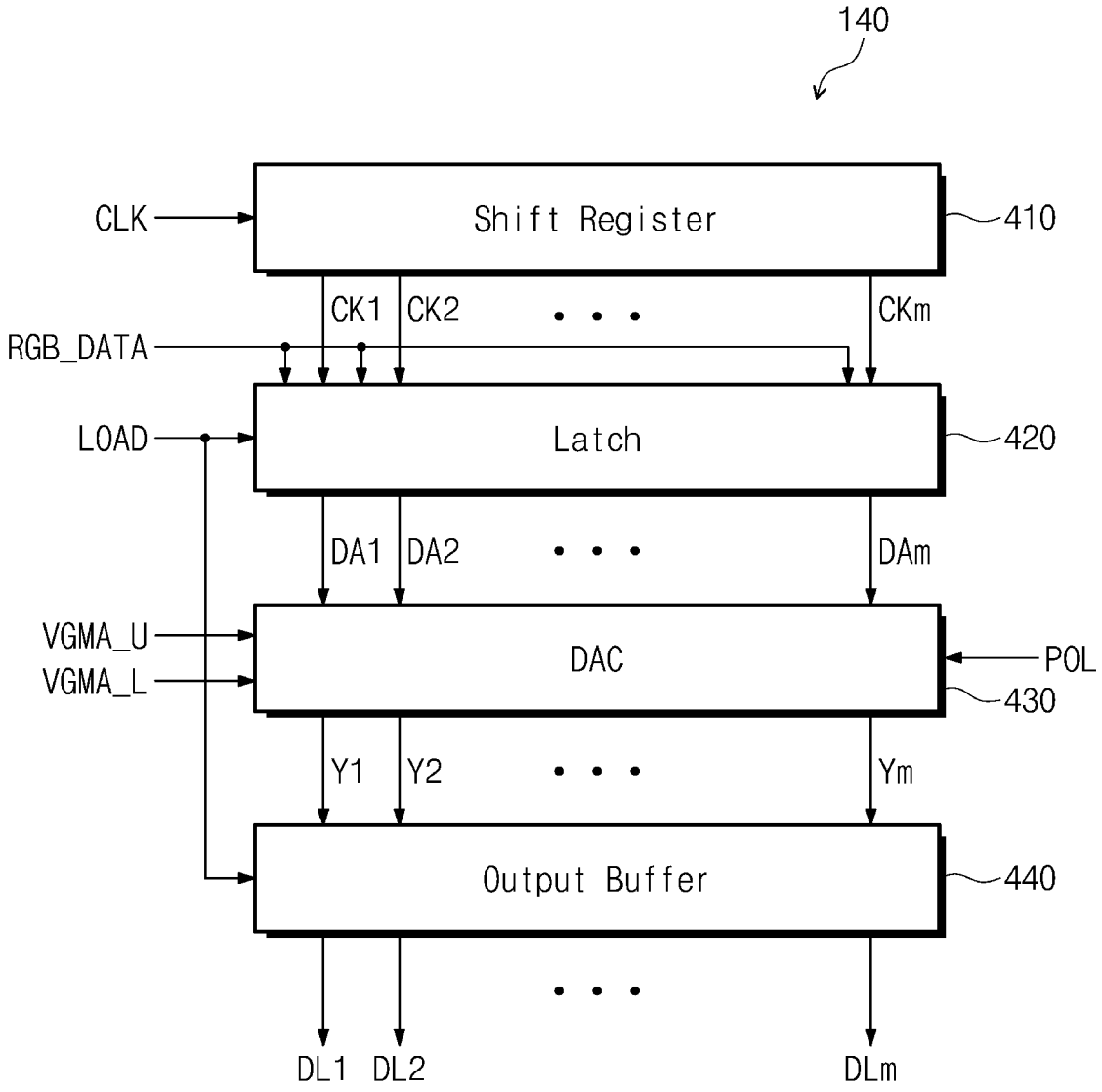
FIG. 7 is a block diagram illustrating an exemplary embodiment of a configuration of a data driving circuit according to the invention.

FIG. 7 is a block diagram illustrating a configuration of a data driving circuit according to an exemplary embodiment of the invention.

Referring to FIG. 7, the data driving circuit 140 includes a shift register 410, a latch unit 420, a digital-to-analog converter ("DAC") 430, and an output buffer 440. In FIG. 7, the clock signal CLK, the line latch signal LOAD, and the polarity inversion signal POL are signals included in the first control signal CONT1 provided from the controller 151 shown in FIG. 6

The shift register 410 sequentially activates latch clock signals CK1 to CKm in response to the clock signal CLK. The latch unit 420 latches the image data signal RGB_DATA in synchronization with the latch clock signals CK1 to CKm from the shift register 410 and provides the latch data signals DA1 to DAm to the DAC 430 at the same time in response to the line latch signal LOAD.

The DAC 430 receives the polarity inversion signal POL from the controller 151 shown in FIG. 6 and the first gamma reference voltage VGMA_U and the second gamma reference voltage VGMA_L from the voltage generator 153. The DAC 430 outputs the grayscale voltages Y1 to Ym corresponding to the latch data signals DA to DAm from the latch unit 420 to the output buffer 440. The output buffer 440 outputs the grayscale voltages Y1 to Ym from the DAC 430 to the data lines DL1 to DLm in response to the line latch signal LOAD.

Figure 8A:
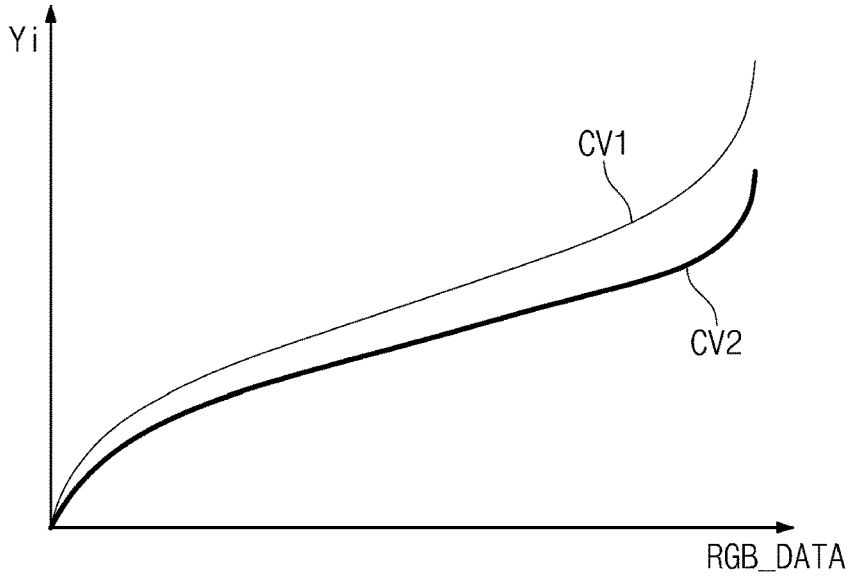
FIG. 8A is a view illustrating a positive grayscale voltage change according to a change of a first gamma reference voltage.
Figure 8B:
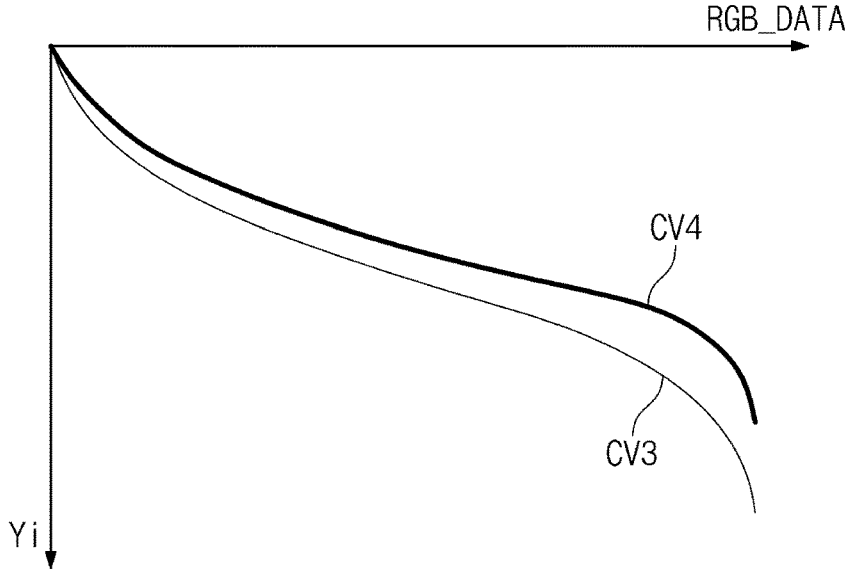
FIG. 8B is a view illustrating a negative grayscale voltage change according to a change of a second gamma reference voltage.

FIG. 8A is a view illustrating a positive grayscale voltage change according to a change of a first gamma reference voltage. FIG. 8B is a view illustrating a negative grayscale voltage change according to a change of a second gamma reference voltage.

First, referring to FIGS. 6, 7 and 8A, when the first gamma reference voltage VGMA_U generated by the voltage generator 153 is in a predetermined voltage level, the positive grayscale voltage Yi may be expressed as the first positive polarity gamma curve CV1 according to the image data signal RGB_DATA. When the first gamma reference voltage VGMA_U generated by the voltage generator 153 is lowered at a predetermined voltage level, the positive grayscale voltage Yi changes to the second positive gamma curve CV2.

Referring to FIGS. 6, 7 and 8B, when the second gamma reference voltage VGMA_L generated by the voltage generator 153 is in a predetermined voltage level, the negative grayscale voltage Yi may be expressed as the third negative gamma curve CV3 according to the image data signal RGB_DATA. When the second gamma reference voltage VGMA_L generated by the voltage generator 153 is lowered at a predetermined voltage level, the positive grayscale voltage Yi changes to the fourth negative gamma curve CV4.

In relation to the characteristic of the grayscale voltage Yi provided to the data lines DL1 to DLm, when the first positive gamma curve CV1 is changed to the second positive gamma curve CV2 and the third negative gamma curve CV3 is changed to the fourth negative gamma curve CV4, the luminance of an image displayed on the display panel 110 shown in FIG. 1 becomes lowered. In relation to the characteristic of the grayscale voltage Yi provided to the data lines DL1 to DLm, when the second positive gamma curve CV2 is changed to the first positive gamma curve CV1 and the fourth negative gamma curve CV4 is changed to the third negative gamma curve CV3, the luminance of an image displayed on the display panel 110 shown in FIG. 1 becomes higher. Therefore, the luminance of an image may be adjusted by changing the voltage level of the first gamma reference voltage VGMA_U and the second gamma reference voltage VGMA_L.

Figure 9:
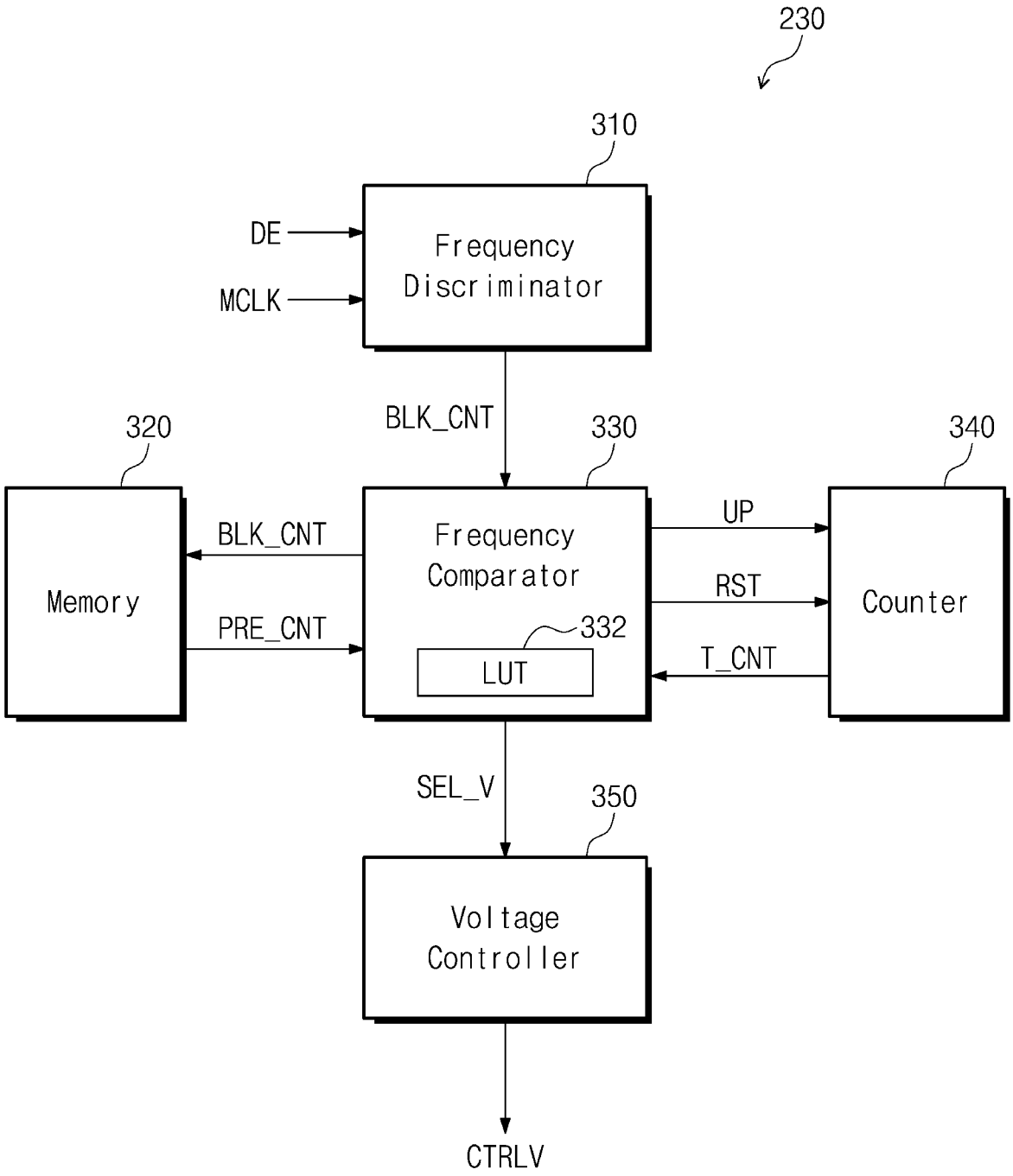
FIG. 9 is a block diagram illustrating an exemplary embodiment of a control signal generator according to the invention.

FIG. 9 is a block diagram of a control signal generator according to an exemplary embodiment of the invention.

Referring to FIG. 9, the control signal generator 230 includes a frequency discriminator 310, a memory 320, a frequency comparator 330, a counter 340, and a voltage controller 350. The frequency discriminator 310 counts the main clock signal MCLK during the blank section of the data enable signal DE and outputs the current blank count signal BLK_CNT. The current blank count signal BLK_CNT means a value corresponding to the time length of the data enable signal DE.

The frequency comparator 330 compares the current blank count signal BLK_CNT with the previous blank count signal PRE_CNT from the memory 320 and when a difference between the current blank count signal BLK_CNT and the previous blank count signal PRE_CNT is greater than a reference value, outputs the voltage selection signal SEL_V corresponding to the current blank count signal BLK_CNT. The frequency comparator 330 includes a lookup table ("LUT") 332 that stores a plurality of reference values corresponding to a plurality of frequency sections, respectively. The LUT 332 will be described later in detail. The frequency comparator 330 stores the current blank count signal BLK_CNT in the memory 320.

When the difference between the current blank count signal BLK_CNT and the previous blank count signal PRE_CNT is 0, that is, when the current blank count signal BLK_CNT and the previous blank count signal PRE_CNT are the same, the frequency comparator 330 provides the count-up signal UP to the counter 340.

The counter 340 performs a count-up operation in response to the count-up signal UP and provides a time count signal T_CNT to the frequency comparator 330. The frequency comparator 330 outputs a voltage selection signal SEL_V corresponding to the current blank count signal BLK_CNT when the time count signal T_CNT corresponds to a predetermined time. When the time count signal T_CNT corresponds to a predetermined time or when the difference between the current blank count signal BLK_CNT and the previous blank count signal PRE_CNT is not 0, the frequency comparator 330 provides the reset signal RST to the counter 340. The counter 340 resets the time count signal T_CNT to 0 in response to the reset signal RST.

The voltage controller 350 outputs the voltage control signal CTRLV corresponding to the voltage selection signal SEL_V. In an exemplary embodiment, the voltage controller 350 may convert the voltage selection signal SEL_V to a voltage control signal CTRLV suitable for the I2C interface, for example.

Figure 10:
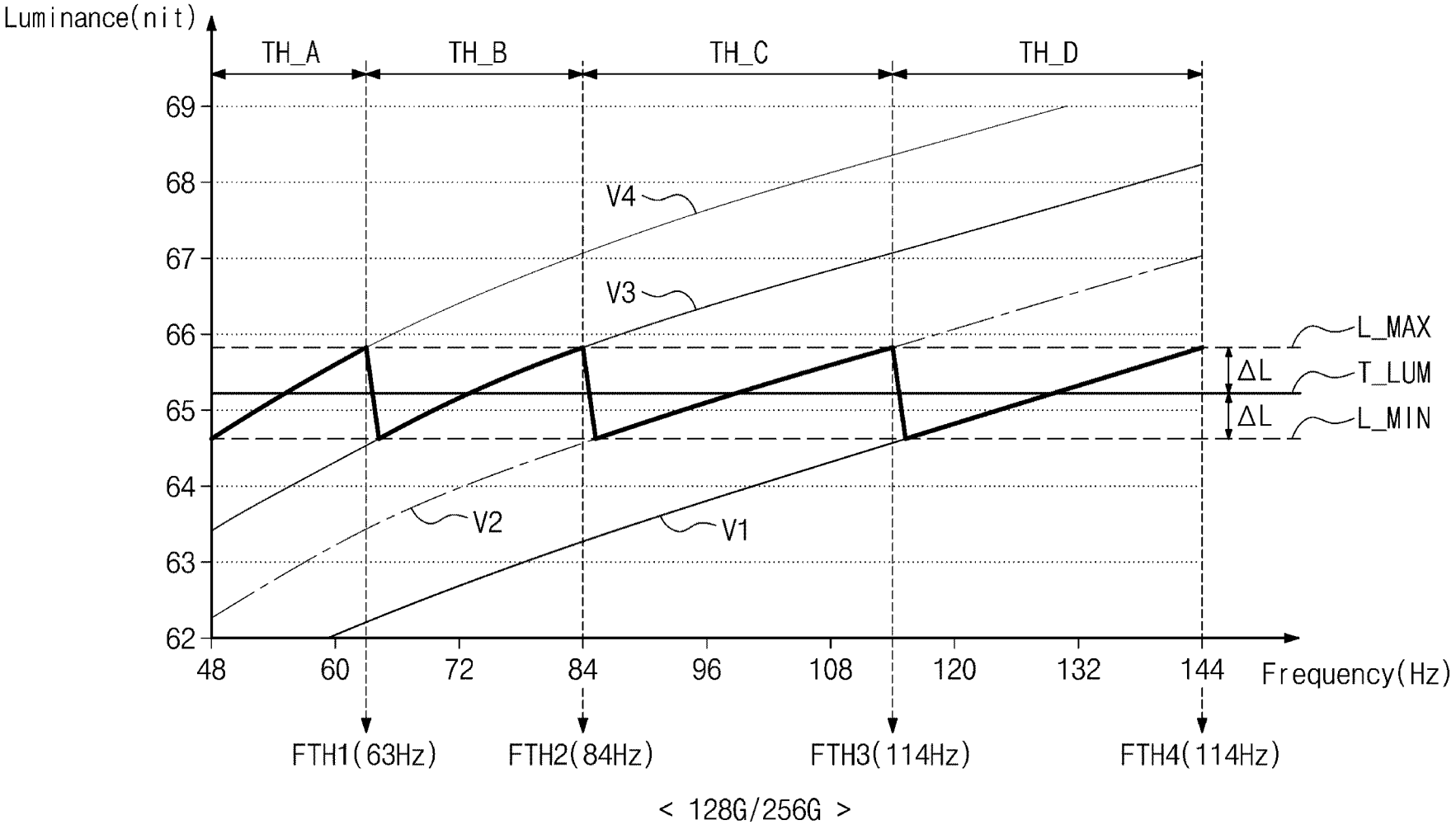
FIG. 10 is a view illustrating a change in luminance of an image corresponding to 128 grayscales when a first gamma reference voltage and a second gamma reference voltage are changed according to a frame frequency.

FIG. 10 is a view illustrating a change in luminance of an image corresponding to 128 grayscales when a first gamma reference voltage and a second gamma reference voltage are changed according to a frame frequency.

Referring to FIGS. 6, 9 and 10, the control signal generator 230 sets a target luminance T_LUM which is the optimal luminance for each of the grayscales (e.g., 1G to 256G). The control signal generator 230 sets a maximum luminance LMAX as high as a predetermined luminance ΔL and a minimum luminance L_MIN as low as the predetermined luminance ΔL with respect to the target luminance T_LUM.

The first gamma reference voltage VGMA_U generated in the voltage generator 153 of FIG. 6 is sequentially set from the first voltage level V1 to the fourth voltage level V4, and when the frame frequency of the data enable signal DE is changed, the luminance of an image is changed as shown in FIG. 10.

The LUT 332 in the frequency comparator 330 stores reference frequencies FTH1, FTH3, FTH3, and FTH4 and difference value ranges TH_A, TH_B, TH_C, and TH_D respectively corresponding to the reference frequencies FTH1, FTH3, FTH3, and FTH4. [Table 1] exemplarily shows reference frequencies and difference value ranges stored in the LUT 332.

TABLE 1

| Reference frequency | Difference value range |
|---|---|
| FTH1 (63 Hz) | TH_A (15 Hz) |
| FTH2 (84 Hz) | TH_B (21 Hz) |
| FTH3 (114 Hz) | TH_C (30 Hz) |
| FTH4 (144 Hz) | TH_D (30 Hz) |

As described above, when the blank section of the data enable signal DE becomes long, the frame frequency becomes low, and when the blank section becomes short, the frame frequency becomes high. When the current blank count signal BLK_CNT is received from the frequency discriminator 310, the frequency comparator 330 performs the search that which one of the reference frequencies FTH1, FTH3, FTH3, and FTH4 the current blank count signal BLK_CNT corresponds to.

In an exemplary embodiment, when the current blank count signal BLK_CNT is smaller than a value corresponding to the reference frequency FTH1, it is regarded that the current blank count signal BLK_CNT corresponds to the reference frequency FTH1, and when the count signal BLK_CNT is smaller than a value corresponding to the reference frequency FTH2, it is regarded that the current blank count signal BLK_CNT corresponds to the reference frequency FTH2, for example.

When the difference between the current blank count signal BLK_CNT and the previous blank count signal PRE_CNT is less than the difference value range TH_A as the current blank count signal BLK_CNT corresponds to the reference frequency FTH1, the frequency comparator 330 does not change the voltage selection signal SEL_V.

When the difference between the current blank count signal BLK_CNT and the previous blank count signal PRE_CNT is greater than the difference value range TH_A, the frequency comparator 330 outputs a voltage selection signal SEL_V for changing the voltage selection signal SEL_V to a voltage corresponding to the current blank count signal BLK_CNT.

In an exemplary embodiment, when the current blank count signal BLK_CNT corresponds to 108 Hertz (Hz) and the previous blank count signal PRE_CNT corresponds to 96 Hz, since a difference (12 Hz) between the current blank count signal BLK_CNT and the previous blank count signal PRE_CNT is smaller than a difference value range (TH_C=30 Hz), the frequency comparator 330 does not change the voltage selection signal SEL_V, for example.

When the current blank count signal BLK_CNT corresponds to 108 Hz and the previous blank count signal PRE_CNT corresponds to 72 Hz, since the difference (36 Hz) between the current blank count signal BLK_CNT and the previous blank count signal PRE_CNT is greater than a difference value range (TH_C=30 Hz), the frequency comparator 330 outputs the voltage selection signal SEL_V corresponding to the second voltage level V2 corresponding to the current blank count signal BLK_CNT, for example.

When the first gamma reference voltage VGMA_U is selected as one of the first voltage level V1 to the fourth voltage level V4 in such a way, while the frequency of the data enable signal DE changes from 48 Hz to 144 Hz, an image of 128 grayscales changes to a luminance within the range of a maximum luminance L_MAX and a minimum luminance L_MIN based on a target luminance T_LUM. Specifically, when the frequency of the previous frame and the frequency of the current frame are changed within a predetermined range, the first gamma reference voltage VGMA_U and the second gamma reference voltage VGMA_L are not changed, thereby preventing flickers due to frequent changes in luminance.

As one example, when the current blank count signal BLK_CNT corresponds to 120 Hz and the previous blank count signal PRE_CNT corresponds to 108 Hz, since a difference (12 Hz) between the current blank count signal BLK_CNT and the previous blank count signal PRE_CNT is smaller than a difference value range (TH_C=30 Hz), the frequency comparator 330 does not change the voltage selection signal SEL_V. At this time, it is assumed that the voltage selection signal SEL_V corresponds to the second voltage level V2. When the current blank count signal BLK_CNT corresponds to 122 Hz in the next frame and the previous blank count signal PRE_CNT corresponds to 120 Hz, since a difference (2 Hz) between the current blank count signal BLK_CNT and the previous blank count signal PRE_CNT is smaller than a difference value range (TH_D=30 Hz), the frequency comparator 330 does not change the voltage selection signal SEL_V. Therefore, the voltage selection signal SEL_V is maintained at a value corresponding to the second voltage level V2.

When the current blank count signal BLK_CNT is maintained at the same value for several tens of frames, the voltage selection signal SEL_V may be changed to the first voltage level V2 corresponding to the current blank count signal BLK_CNT.

When the time count signal T_CNT from the counter 340 reaches a value corresponding to a predetermined time, the frequency comparator 330 changes the voltage selection signal SEL_V to the first voltage level corresponding to the current blank count signal BLK_CNT.

Figure 11:
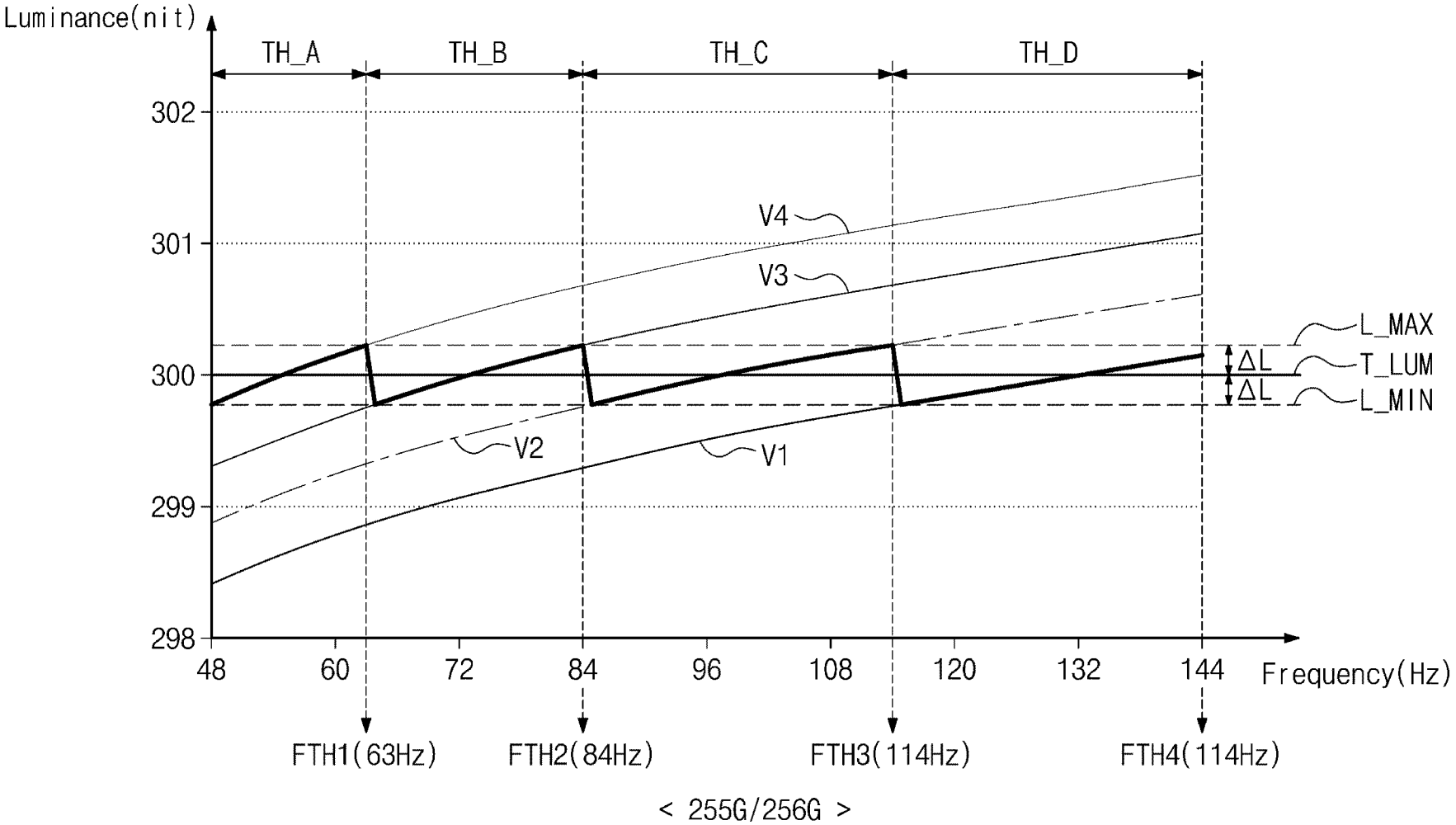
FIG. 11 is a view illustrating a change in luminance of an image corresponding to 255 grayscales when a first gamma reference voltage and a second gamma reference voltage are changed according to a frame frequency.

FIG. 11 is a view illustrating a change in luminance of an image corresponding to 255 grayscales when a first gamma reference voltage and a second gamma reference voltage are changed according to a frame frequency.

Referring to FIG. 11, when the first gamma reference voltage VGMA_U is changed to the first voltage level V1 to the fourth voltage level V4 as the frame frequency of the data enable signal DE changes, the luminance of an image corresponding to 255 grayscales may be changed between the maximum luminance L_MAX as high as the predetermined luminance ΔL and the minimum luminance L_MIN as low as the predetermined luminance ΔL with respect to the target luminance T_LUM.

Figure 12:
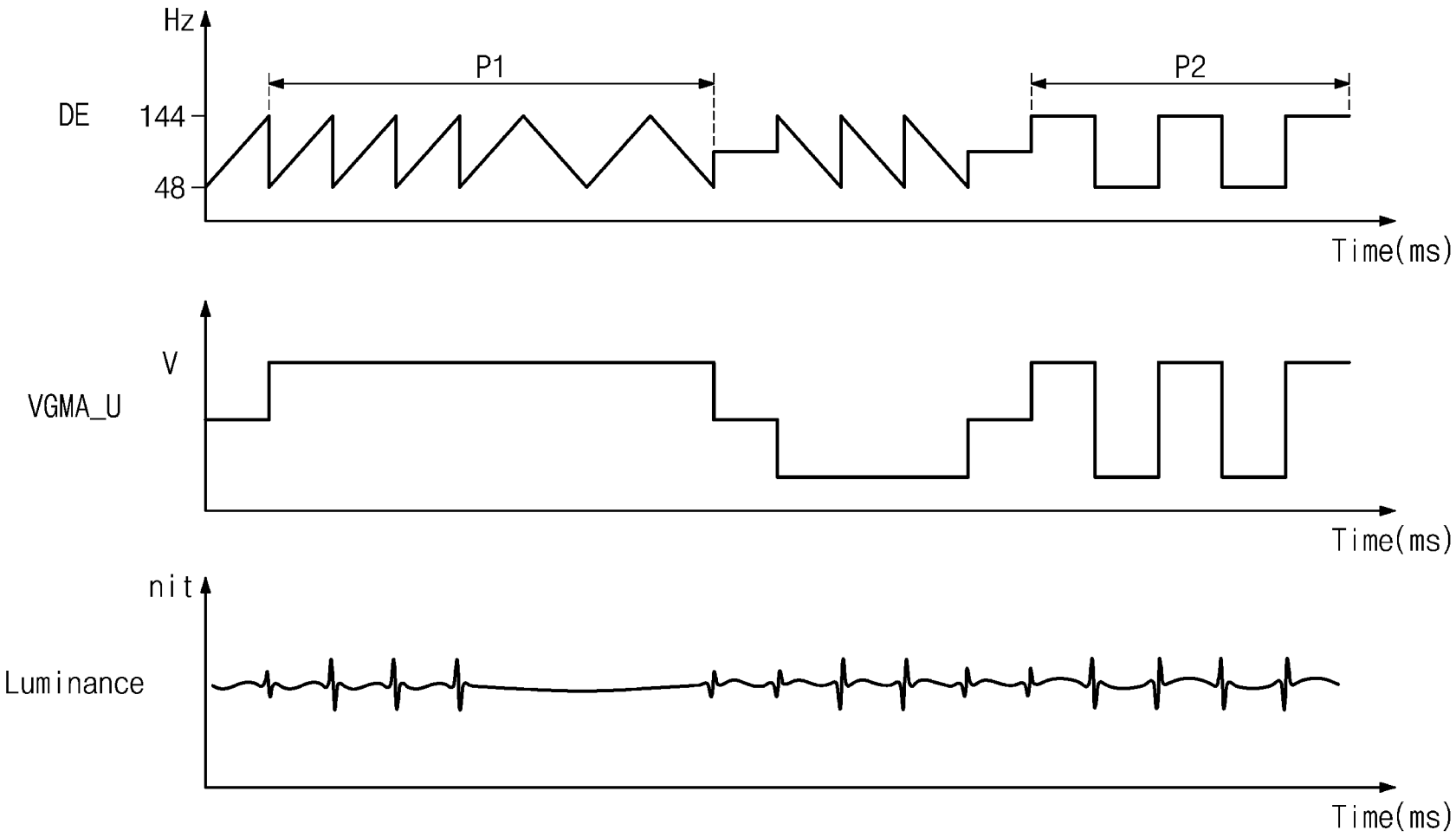
FIG. 12 is a view illustrating a change in luminance when a frame frequency is changed.

FIG. 12 is a view illustrating a change in luminance when a frame frequency is changed.

Referring to FIG. 12, the first gamma reference voltage VGMA_U is not changed during the section P1 in which the frame frequency of the data enable signal DE is gradually changed. Therefore, it is possible to prevent the occurrence of flicker due to a sudden change in luminance of the first gamma reference voltage VGMA_U. Since a change amount of a leakage current due to a frame frequency change is great in the section P2 in which the frame frequency of the data enable signal DE is drastically changed, it may be possible to change the first gamma reference voltage VGMA_U according to a frame frequency.

Figure 13:
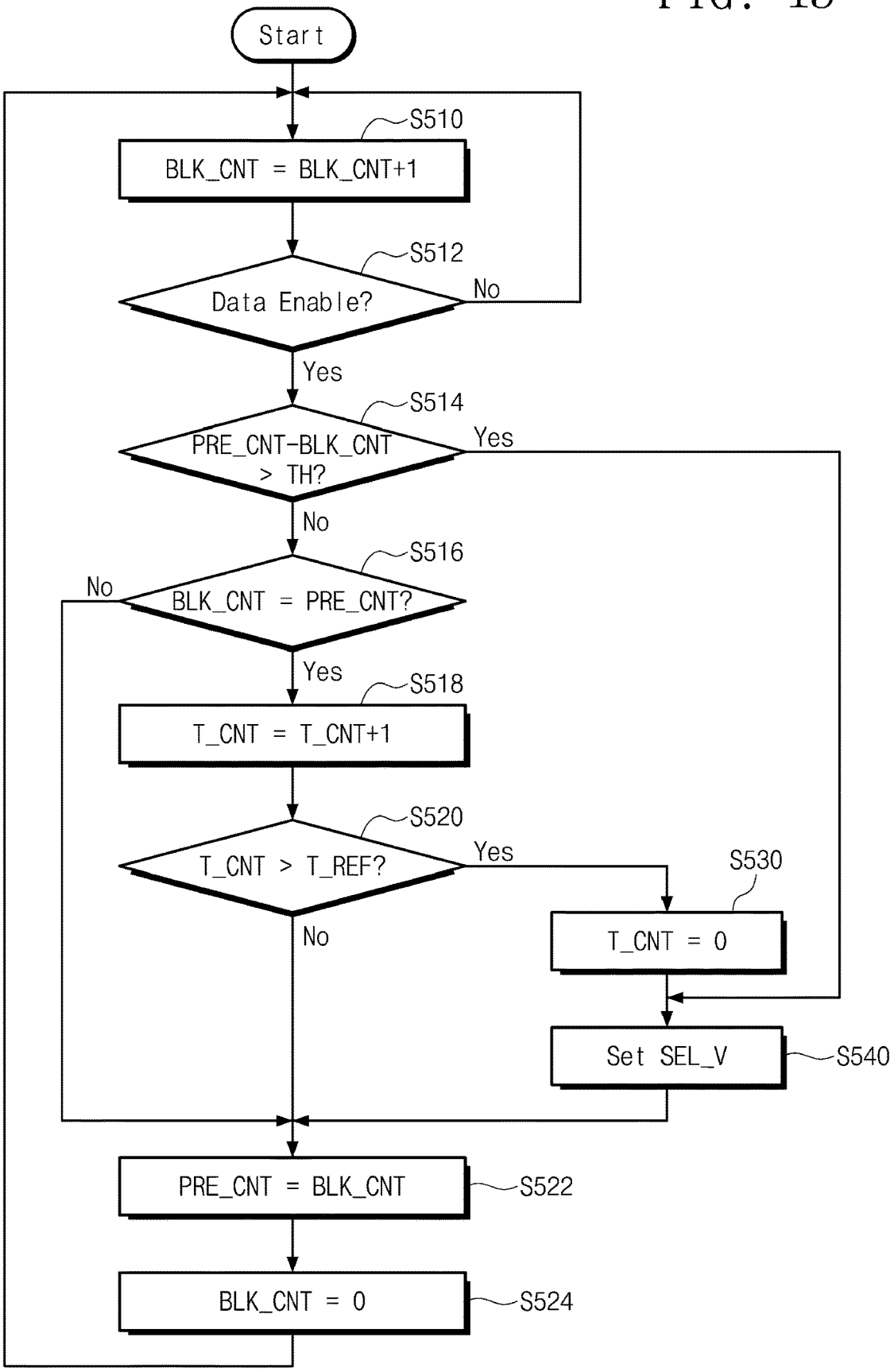
FIG. 13 is a flowchart illustrating an exemplary embodiment of a driving method of a display device according to the invention.

FIG. 13 is a flowchart illustrating a driving method of a display device according to an exemplary embodiment of the invention.

Referring to FIGS. 9 and 13, the frequency discriminator 310 receives the data enable signal DE and the main clock signal MCLK. The frequency discriminator 310 performs a count operation in synchronization with the main clock signal MCLK from the time when the data enable signal DE transitions to a low level (operation S510). When the data enable signal DE transitions from a low level to a high level, control proceeds to operation S514 (operation S512). The frequency discriminator 310 repeats the counting operation in synchronization with the main clock signal MCLK while the data enable signal DE is maintained at a low level. When the data enable signal DE transitions from a low level to a high level, the frequency discriminator 310 provides the current blank count signal BLK_CNT to the frequency comparator 330.

The frequency comparator 330 compares the difference between the current blank count signal BLK_CNT and the previous blank count signal PRE_CNT from the memory 320 with the reference value TH (operation S514). When the difference between the current blank count signal BLK_CNT and the previous blank count signal PRE_CNT is greater than the reference value TH, the frequency comparator 330 sets the voltage selection signal SEL_V to a value corresponding to the current blank count signal BLK_CNT (operation S540). The voltage controller 350 outputs the voltage control signal CTRLV corresponding to the voltage selection signal SEL_V. The voltage generator 153 shown in FIG. 6 provides the first gamma reference voltages VGMA_U and VGMA_L corresponding to the voltage control signal CTRLV to the data driving circuit 140 shown in FIG. 1.

When the current blank count signal BLK_CNT and the previous blank count signal PRE_CNT are the same as each other (operation S516), the frequency comparator 330 provides the count-up signal UP to the counter 340. The counter 340 provides a time count signal T_CNT that is counted up by one to the frequency comparator 330 (operation S518).

The frequency comparator 330 provides the reset signal RST to the counter 340 when the time count signal T_CNT is greater than the reference time (operation S520). The counter 340 resets the time count signal T_CNT to 0 in response to the reset signal RST (operation S530).

The frequency comparator 330 sets the voltage selection signal SEL_V to a value corresponding to the current blank count signal BLK_CNT (operation S540) when the time count signal T_CNT is greater than the reference time (operation S520). The voltage controller 350 outputs the voltage control signal CTRLV corresponding to the voltage selection signal SEL_V. The voltage generator 153 shown in FIG. 6 provides the first gamma reference voltages VGMA_U and VGMA_L corresponding to the voltage control signal CTRLV to the data driving circuit 140 shown in FIG. 1.

The frequency comparator 330 stores the current blank count signal BLK_CNT in the memory 320 (operation S522).

The frequency discriminator 410 resets the current blank count signal BLK_CNT to zero (operation S524), and control is repeated from operation S510.

Figure 14:
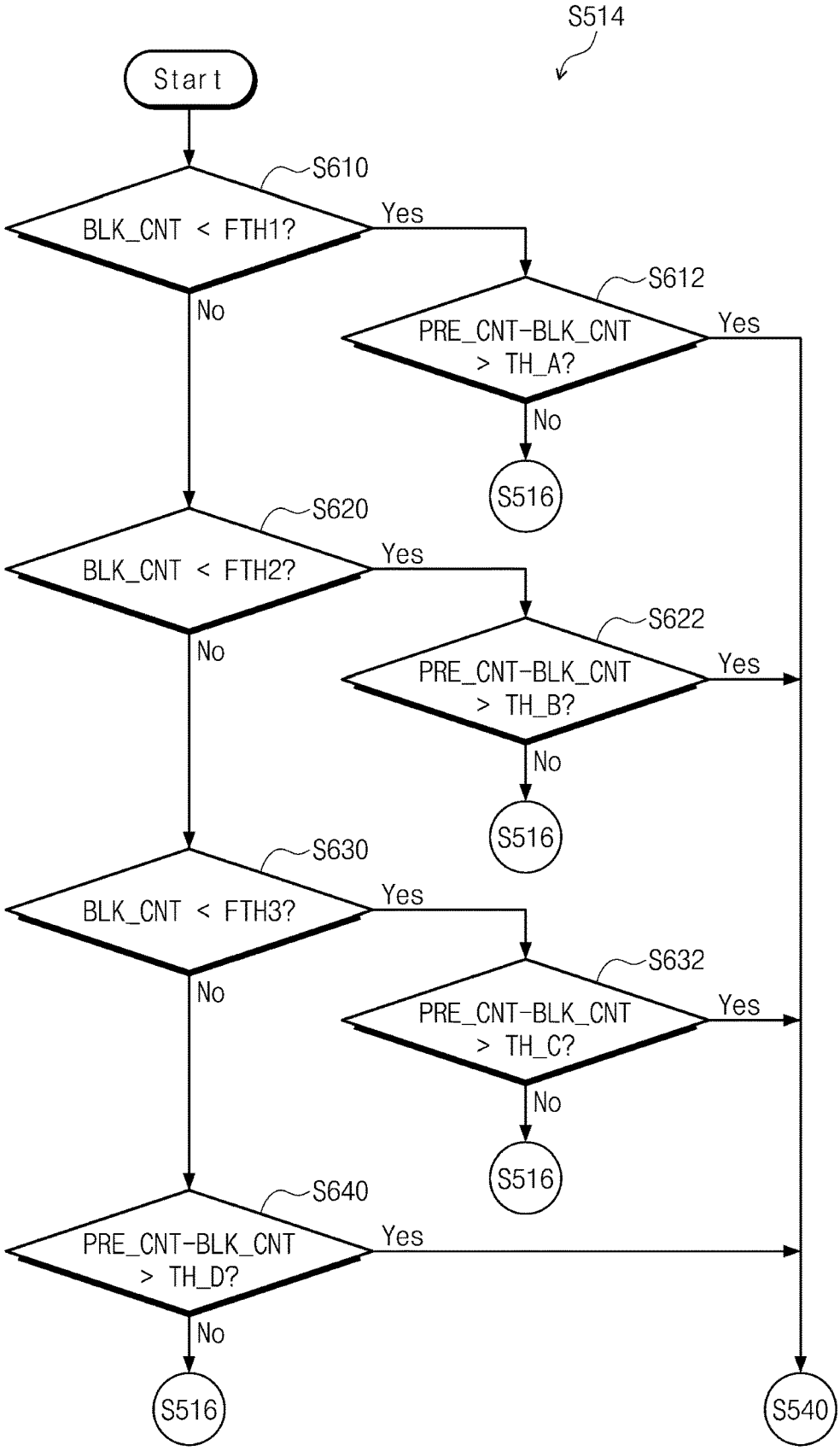
FIG. 14 is a flowchart illustrating a specific method of comparing a difference between a current blank count signal and a previous blank count signal shown in FIG. 13.

FIG. 14 is a flowchart illustrating a specific method of comparing a difference between a current blank count signal and a previous blank count signal shown in FIG. 13.

Referring to FIGS. 9, 13 and 14, the frequency comparator 330 determines whether the current blank count signal BLK_CNT is smaller than a value corresponding to the reference frequency FTH1 (operation S610).

When the current blank count signal BLK_CNT is smaller than the value corresponding to the reference frequency FTH1, the frequency comparator 330 determines whether the difference between the previous blank count signal PRE_CNT and the current blank count signal BLK_CNT is greater than the difference value range TH_A (operation S612). When the difference between the previous blank count signal PRE_CNT and the current blank count signal BLK_CNT is greater than the difference value range TH_A, control proceeds to operation S540 shown in FIG. 13. The frequency comparator 330 sets the voltage selection signal SEL_V to a value corresponding to the current blank count signal BLK_CNT.

The frequency comparator 330 determines whether the current blank count signal BLK_CNT is smaller than a value corresponding to the reference frequency FTH2 (operation S620).

When the current blank count signal BLK_CNT is smaller than the value corresponding to the reference frequency FTH2, the frequency comparator 330 determines whether the difference between the previous blank count signal PRE_CNT and the current blank count signal BLK_CNT is greater than the difference value range TH_B (operation S622). When the difference between the previous blank count signal PRE_CNT and the current blank count signal BLK_CNT is greater than the difference value range TH_B, control proceeds to operation S540 shown in FIG. 13. The frequency comparator 330 sets the voltage selection signal SEL_V to a value corresponding to the current blank count signal BLK_CNT.

The frequency comparator 330 determines whether the current blank count signal BLK_CNT is smaller than a value corresponding to the reference frequency FTH3 (operation S630).

When the current blank count signal BLK_CNT is smaller than the value corresponding to the reference frequency FTH3, the frequency comparator 330 determines whether the difference between the previous blank count signal PRE_CNT and the current blank count signal BLK_CNT is greater than the difference value range TH_C (operation S632). When the difference between the previous blank count signal PRE_CNT and the current blank count signal BLK_CNT is greater than the difference value range TH_C, control proceeds to operation S540 shown in FIG. 13. The frequency comparator 330 sets the voltage selection signal SEL_V to a value corresponding to the current blank count signal BLK_CNT.

In operation S630, when the current blank count signal BLK_CNT is greater than the value corresponding to the reference frequency FTH3, the frequency comparator 330 determines whether the difference between the previous blank count signal PRE_CNT and the current blank count signal BLK_CNT is greater than the difference value range TH_D (operation S640). When the difference between the previous blank count signal PRE_CNT and the current blank count signal BLK_CNT is greater than the difference value range TH_D, control proceeds to operation S540 shown in FIG. 13. The frequency comparator 330 sets the voltage selection signal SEL_V to a value corresponding to the current blank count signal BLK_CNT.

When the difference between the previous blank count signal PRE_CNT and the current blank count signal BLK_CNT is less than or equal to the difference value range TH_D, control proceeds to operation S516 shown in FIG. 13.

Thus, the frequency comparator 330 may store in the LUT 332 the reference frequencies FTH1, FTH3, FTH3, and FTH4 and the difference value ranges TH_A, TH_B, TH_C, and TH_D corresponding to the reference frequencies FTH1, FTH3, FTH3, and FTH4, and may set the voltage selection signal SEL_V according to the frequency section to which the current blank count signal BLK_CNT belongs and the difference between the previous blank count signal PRE_CNT and the current blank count signal BLK_CNT. Only when the difference between the time length of the blank section of the current frame and the time length of the blank section of the previous frame is greater than the predetermined difference value ranges TH_A, TH_B, TH_C, and TH_D, the occurrence of flicker may be minimized by changing to a voltage level corresponding to the current blank count signal BLK_CNT.

By setting a voltage level of a driving reference voltage provided to a data driving circuit according to the time length of a blank section when a frame frequency is changed, such a display device having such a configuration may minimize the luminance change of an image displayed on a display panel. In particular, flicker occurrence may be minimized by changing a driving reference voltage to a voltage level corresponding to the current frame frequency only when the difference between the time length of the blank section of the current frame and the time length of the blank section of the previous frame is greater than the reference value. Therefore, the display quality of an image displayed on a display device may be improved.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display device comprising:

a display panel including a plurality of pixels which are respectively connected to a plurality of gate lines and a plurality of data lines;

a gate driving circuit which drives the plurality of gate lines;

a data driving circuit which drives the plurality of data lines based on an image data signal and a driving reference voltage; and a driving controller which controls the gate driving circuit in response to an image signal and a control signal received from an outside and provides the image data signal and the driving reference voltage to the data driving circuit, wherein the driving controller generates a data enable signal having a display section and a blank section in one frame based on the control signal, and when a difference between a time length of the blank section of a current frame and a time length of the blank section of a previous frame is greater than a reference value, changes the driving reference voltage provided to the data driving circuit to a voltage level corresponding to a current frame frequency.

2. The display device of claim 1, wherein the driving reference voltage has a voltage level corresponding to a white gamma signal.

3. The display device of claim 2, wherein when the difference between the time length of the blank section of the current frame and the time length of the blank section of the previous frame is greater than the reference value and the time length of the blank section of the current frame is longer than the time length of the blank section of the previous frame, the driving controller increases a voltage level of the driving reference voltage by a predetermined level.

4. The display device of claim 2, wherein when the difference between the time length of the blank section of the current frame and the time length of the blank section of the previous frame is greater than the reference value and the time length of the blank section of the current frame is shorter than the time length of the blank section of the previous frame, the driving controller decreases a voltage level of the driving reference voltage by a predetermined level.

5. The display device of claim 1, wherein when the time length of the blank section of the current frame and the time length of the blank section of the previous frame are the same as each other during a predetermined frame, the driving controller changes the driving reference voltage to a voltage level corresponding to the current frame frequency.

6. The display device of claim 1, wherein the driving controller determines a frequency of the current frame according to the time length of the blank section of the current frame.

7. The display device of claim 6, wherein the driving controller comprises:

a controller which determines the frequency of the current frame based on the data enable signal and output a voltage control signal corresponding to the frequency of the current frame when a difference between a frequency of the previous frame and the frequency of the current frame frequency is greater than a reference value; and a voltage generator which generates the driving reference voltage in response to the voltage control signal.

8. The display device of claim 7, wherein the controller comprises:

a receiver which restores the data enable signal and a clock signal based on the control signal; and a control signal generator which determines a current frame blank time by counting the clock signal during the blank section of the data enable signal, and outputs the voltage control signal corresponding to the current frame blank time when a difference between the current frame blank time and a previous frame blank time is greater than the reference value.

9. The display device of claim 8, wherein the control signal generator comprises:

a frequency discriminator which counts the clock signal during the blank section of the data enable signal and output a current blank count signal;

a frequency comparator which compares the current blank count signal and a previous blank count signal and outputs a voltage selection signal corresponding to the current blank count signal when a difference between the current blank count signal and the previous blank count signal is greater than the reference value; and a voltage controller which outputs the voltage control signal corresponding to the voltage selection signal.

10. The display device of claim 9, wherein the control signal generator further comprises a memory which stores the previous blank count signal.

11. The display device of claim 10, wherein the frequency comparator comprises:

a lookup table which stores a plurality of reference values respectively corresponding to a plurality of frequency sections, and selects a frequency section corresponding to the current blank count signal from the plurality of frequency sections and outputs the voltage selection signal corresponding to the current blank count signal when a difference between the current blank count signal and the previous blank count signal is greater than a reference value corresponding to the selected frequency section.

12. The display device of claim 11, wherein the lookup table comprises:

a first reference value corresponding to a first frequency section and a second reference value corresponding to a second frequency section, wherein the frequency comparator outputs a first voltage selection signal corresponding to the current blank count signal when a difference between the current blank count signal and the previous blank count signal is greater than the first reference value when the current blank count signal corresponds to the first frequency section, and outputs a second voltage selection signal corresponding to the current blank count signal when the difference between the current blank count signal and the previous blank count signal is greater than the second reference value when the current blank count signal corresponds to the second frequency section, wherein a first voltage level of the driving reference voltage corresponding to the first voltage selection signal is higher than a second voltage level of the driving reference voltage corresponding to the second voltage selection signal.

13. The display device of claim 9, wherein the control signal generator further comprises:

a counter which counts up when the current blank count signal is identical to the previous blank count signal and outputs a time count signal, wherein the frequency comparator outputs the voltage selection signal corresponding to the current blank count signal when the time count signal corresponds to a predetermined time.

14. A driving method of a display device, the driving method comprising:

generating a data enable signal having a display section and a blank section in one frame and a clock signal based on a received control signal;

determining a current blank time by counting the clock signal during the blank section of the data enable signal;

setting a driving reference voltage to a voltage level corresponding to the current frame blank time when a difference between the current frame blank time and a previous frame blank time is greater than a reference value; and providing the driving reference voltage to a data driving circuit.

15. The method of claim 14, wherein the driving reference voltage has a voltage level corresponding to a white gamma signal.

16. The method of claim 15, wherein the setting the voltage level comprises increasing a voltage level of the driving reference voltage by a predetermined level when the difference between the current frame blank time and the previous frame blank time is greater than the reference value and the current frame blank time is longer than the previous frame blank time.

17. The method of claim 15, wherein the setting the voltage level comprises decreasing a voltage level of the driving reference voltage by a predetermined level when the difference between the current frame blank time and the previous frame blank time is greater than the reference value and the current frame blank time is shorter than the previous frame blank time.

18. The method of claim 15, wherein the setting the voltage level comprises changing the driving reference voltage to a voltage level corresponding to the current frame blank time when the current frame blank time and the previous frame blank time are the same as each other during a predetermined frame.

19. The method of claim 14, wherein the setting the voltage level comprises:

changing the driving reference voltage to a voltage level corresponding to the current frame blank time when the current blank time is less than a first reference value and the difference between the current frame blank time and the previous frame blank time is greater than a first difference value; and changing the driving reference voltage to a voltage level corresponding to the current frame blank time when the current blank time is less than a second reference value and the difference between the current frame blank time and the previous frame blank time is greater than a second difference value, wherein the first reference value is less than the second reference value.

* * * * *